US008184087B2

(12) United States Patent
Lin et al.

(10) Patent No.: US 8,184,087 B2
(45) Date of Patent: May 22, 2012

(54) DISPLAY METHOD FOR LCD DEVICE WITH REDUCED COLOR BREAK-UP

(75) Inventors: Fang-Cheng Lin, Wurih Township, Taichung County (TW); Yi-Pai Huang, Chiayi (TW); Ching-Ming Wei, Taichung (TW); Han-Ping D. Shieh, Hsinchu (TW)

(73) Assignee: National Chiao Tung University, Hsinchu (TW)

( * ) Notice: Subject to any disclaimer, the term of this patent is extended or adjusted under 35 U.S.C. 154(b) by 1044 days.

(21) Appl. No.: 12/003,995

(22) Filed: Jan. 4, 2008

(65) Prior Publication Data

US 2009/0115719 A1 May 7, 2009

(30) Foreign Application Priority Data

Nov. 5, 2007 (TW) ..... 96141627 A

(51) Int. Cl.
*G09G 3/36* (2006.01)

(52) U.S. Cl. ..... 345/102; 345/87

(58) Field of Classification Search ..... 345/87–100, 345/102

See application file for complete search history.

(56) References Cited

U.S. PATENT DOCUMENTS 5,337,068 A 8/1994 Stewart et al.
5,717,422 A 2/1998 Fergason
5,828,362 A * 10/1998 Takahashi et al. ..... 345/589
6,891,672 B2 5/2005 Whitehead et al.
7,057,668 B2 * 6/2006 Herrmann ..... 348/554
7,830,358 B2 * 11/2010 Seetzen ..... 345/102
2006/0146007 A1 * 7/2006 Lim et al. ..... 345/102

OTHER PUBLICATIONS

Jongseo Lee et al., "Noble Measurement Method for Color Breakup Artifact in FPDs", IMID/IDMC '06 Digest, pp. 92-97.
Wei-Chung Cheng et al., "Perception-Guided Power Minimization for Color Sequential Displays", National Chiao Tung University, pp. 290-295.
J. H. Stessen et al., "Algorithm for Contrast Reserve, Backlight Dimming, and Backlight Boosting on LCD", SID 06 Digest, pp. 1249-1252.
Kazuo Sekiya, "Late-News Paper: A Simple and Practical Way to Cope with Color Breakup on Field Sequential Color LCDs" SID 06 Digest, pp. 1661-1664.

* cited by examiner

*Primary Examiner* — Alexander Eisen
*Assistant Examiner* — Viet Pham
(74) *Attorney, Agent, or Firm* — Stites & Harbison, PLLC; Juan Carlos A. Marquez, Esq.

(57) ABSTRACT

The present invention provides a display method for an LCD device with reduced color break-up, comprising the following steps: generating a control signal for each sub-frame, and displaying the sub-frames successively. The present invention generates, according to brightness of a screen to be displayed, second backlight control signals and second LC control signals for each display region in the each sub-frame and then, according to the second backlight control signals and the second LC control signals, displays a chromatic sub-frame and a plurality of monochromatic sub-frames successively so that the screen to be displayed can be viewed through human vision. The present invention can not only facilitate reducing color break-up (CBU) of the LCD device, but also can contributes to the LCD device advantaged by high contrast, high color saturation, low power consumption and low manufacturing costs.

19 Claims, 7 Drawing Sheets

DISPLAY METHOD FOR LCD DEVICE WITH REDUCED COLOR BREAK-UP

BACKGROUND OF THE INVENTION

1. Technical Field

The present invention relates to a display method for reducing color break-up of an LCD device and, more particularly, to a display method for an LCD device with reduced color break-up.

2. Description of Related Art

Recently, the progressive development of the flat panel display industry has promoted the display technology and has brought liquid crystal display (LCD) devices featuring for compactness, light-weight and low electromagnetic radiation to a mainstream stage of display products.

In a known LCD device implementing spatial color filters (SCF), each pixel in an LCD module thereof is composed of three sub-pixels, and each of the sub-pixels requires a field effect transistor (TFT) to control electric field intensity thereof. Since each pixel needs at least three field effect transistors and implements color filters, manufacturing of the conventional LCD device is therefore costly and complex and significantly reduces light efficiency of the LCD device. Hence, the field sequential color (FSC) technology has been introduced to the industry. Such FSC technology switches light sources of three primary colors according to a time sequence and synchronously controls transmittance ratio of LCD pixels so as to modulate relative intensity of each said light sources. Afterward, through integration effect of human vision in response to light stimulus, a color to be displayed is viewed.

Since FSC technology achieves chromatic display without implementing color filters and dividing pixels into sub-pixels, the number of the field effect transistors for a single pixel is reduced so as to reduce material costs and simplify proceeding procedures. In an ideal imaging status, the three primary colors contained in a single chromatic image are projected to positions corresponding to each pixel on a human retina so that color information of each said pixel could be reproduced in human vision. However, if the pixels corresponding to color fields of the three primary colors contained in the chromatic image are projected to deviant positions on the human retina, a viewer's vision system can detect such deviation and therefore the viewer views an image with deviant color fields, namely color break-up. As color break-up can significantly debase display quality, it is a serious problem to be solved in the FSC technology.

An approach for remedying color break-up by inserting monochromatic images is as disclosed in the U.S. Pat. No. 7,057,668. This prior invention implements red, green, and blue LEDs in backlight so that when an image signal is input, the input image signal is converted into YCrCb colors. When color break-up is not serious, FSC technology is employed to display screens. When color break-up is serious, another monochromatic screen is inserted and the red, green, and blue LEDs are lighted, so as to change the backlight into a white light with full intensity. As a result, colored strips generated with color break-up can be mixed with the inserted monochromatic screen, so that the human vision system can hardly detect color break-up.

Though the above approach can partially overcome color break-up, when the viewer views the LCD device of FSC technology in the front thereof, since light leak of the LCD device exists and reduces contrast of the LCD device, there is a need for efficiently reducing color break-up while enhancing contrast of an LCD device.

SUMMARY OF THE INVENTION

The present invention provides a display method for an LCD device with reduced color break-up by combining dynamic contrast technology and field sequential color (FSC) technology so as to reduce color break-up (CBU) of the LCD device, and provide the LCD device with advantages of high contrast, low power consumption, high color saturation and low manufacturing costs.

To achieve these and other objectives of the present invention, the display method for an LCD device with reduced color break-up comprises the following steps: generating a control signal for each sub-frame, wherein the control signal comprises a plurality of second backlight control signals a plurality of second LC control signal, and wherein the control signal is generated by the following steps: analyzing an input image signal for acquiring a first LC control signal and a first backlight control signal of each color light at each pixel; dividing the sub-frame into a plurality of display regions; generating the second backlight control signals for each said color light in each said display region according to the first LC control signal; generating the second LC control signal for each said color light at each said pixel in each said display region according to the second backlight control signal; and generating a third LC control signal for each said display region; and displaying a plurality of the sub-frames successively with the following steps: displaying a chromatic sub-frame according to the second backlight control signal of each said color light in each said display region in company with the third LC control signal; and displaying a plurality of color light sub-frames successively according to the second backlight control signal of the color light in each said display region in company with a calculation of the second LC control signal and the third LC control signal color light of the color light at each said pixel.

To achieve these and other objectives of the present invention, the display method for an LCD device with reduced color break-up comprises the following steps: generating a control signal for each sub-frame, wherein the control signal comprises a plurality of second backlight control signals and a plurality of second LC control signals, wherein the control signal is generated by the following steps: analyzing an input image signal for acquiring a first LC control signal and a first backlight control signal of each color light at each pixel; dividing the sub-frame into a plurality of display regions; generating the second backlight control signal for each said color light in each said display region according to the first LC control signal; generating the second LC control signal for each said color light at each said pixel in each said display region according to the second backlight control signal; and generating a third LC control signal for each said display region; and displaying a plurality of sub-frames successively by the following steps: displaying a chromatic sub-frame generated by selecting a first color light and a second color light from a plurality of color lights, and then using the second backlight control signal of the first color light and the second backlight control signal of the second color light in company with the third LC control signal; displaying a first color light sub-frame according to the second backlight control signal of the first color light and a calculation of the second LC control signal and the third LC control signal of the first color light at each said pixel; displaying a second color light sub-frame according to the second backlight control signal of the second color light and a calculation of the second LC control signal and the third LC control signal of the second color light at each said pixel; and displaying a third color light sub-frame by using the second backlight control signal of the third color light and the second LC control signal of the third color light at each said pixel.

By implementing the present invention, at least the following progressive effects can be achieved.

1. Color break-up can be reduced by reducing contribution of each color light sub-frame to the displayed screen.
2. Contrast of an LCD device can be enhanced and power consumption can be reduced by modulating magnitude of backlight signals of different display regions in each sub-frame.

BRIEF DESCRIPTION OF THE DRAWINGS

The invention as well as a preferred mode of use, further objectives and advantages thereof, will best be understood by reference to the following detailed description of an illustrative embodiment when read in conjunction with the accompanying drawings, wherein.

DETAILED DESCRIPTION OF THE PREFERRED EMBODIMENT

Figure 1:
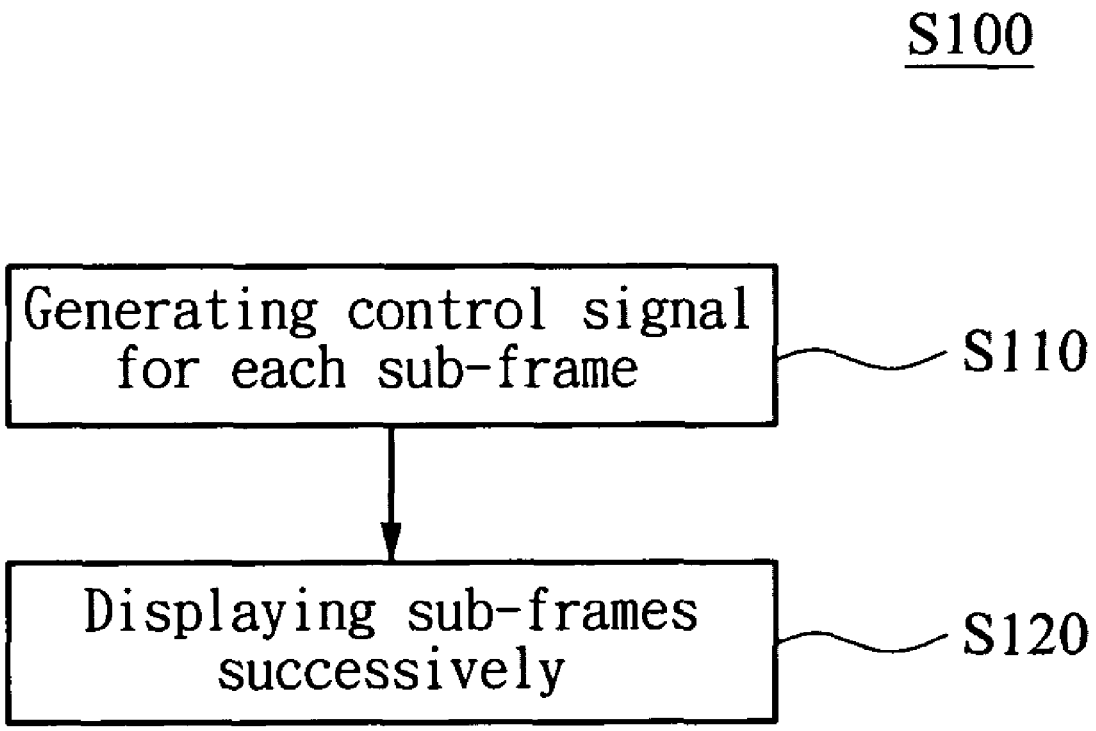
FIG. 1 is a flow chart of an embodiment of a display method for an LCD device with reduced color break-up according to the present invention.
Figure 2:
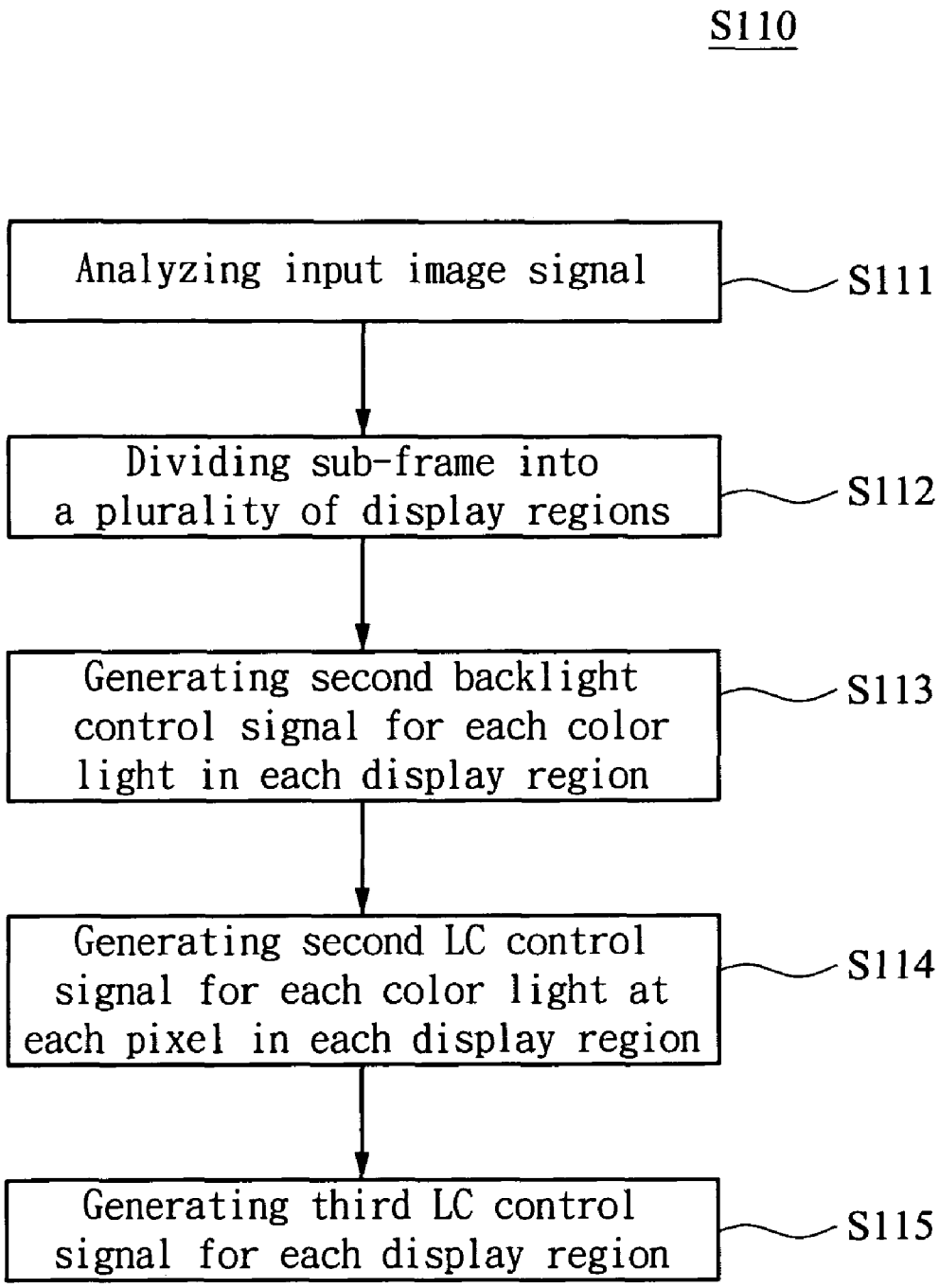
FIG. 2 is a flow chart of an embodiment of generating control signals for each sub-frame according to the present invention.
Figure 3:
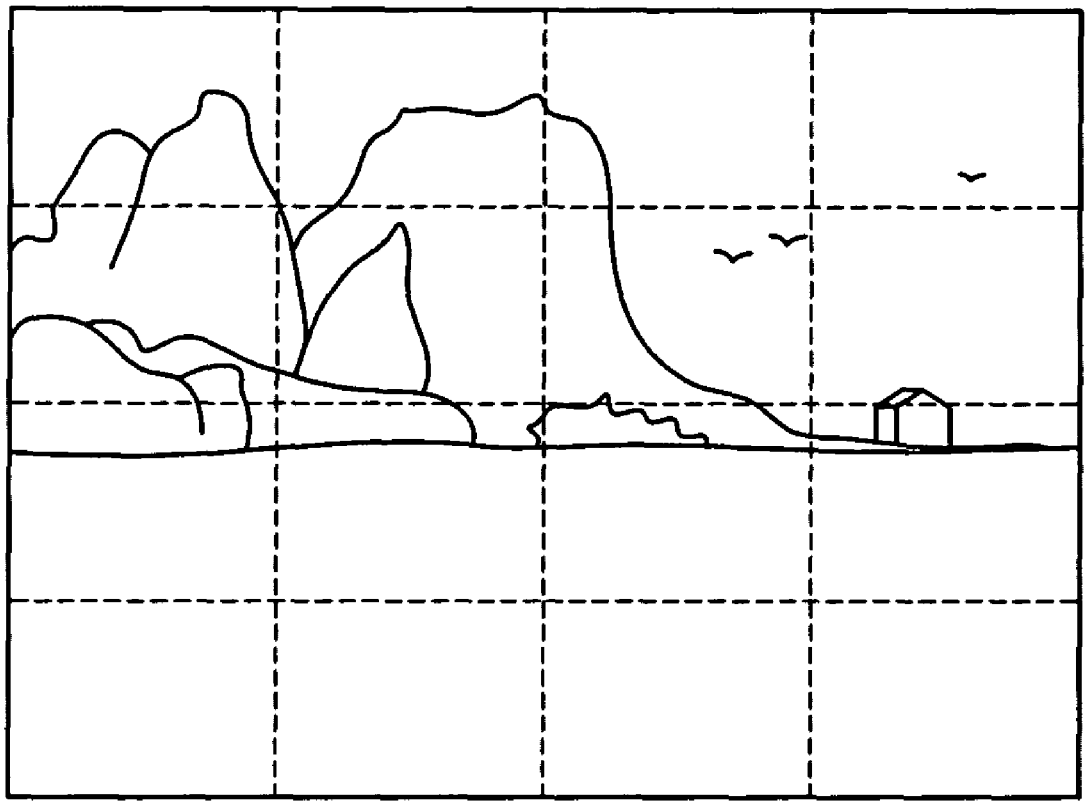
FIG. 3 is an embodiment of a chromatic image to be displayed according to the present invention.
Figure 4A:
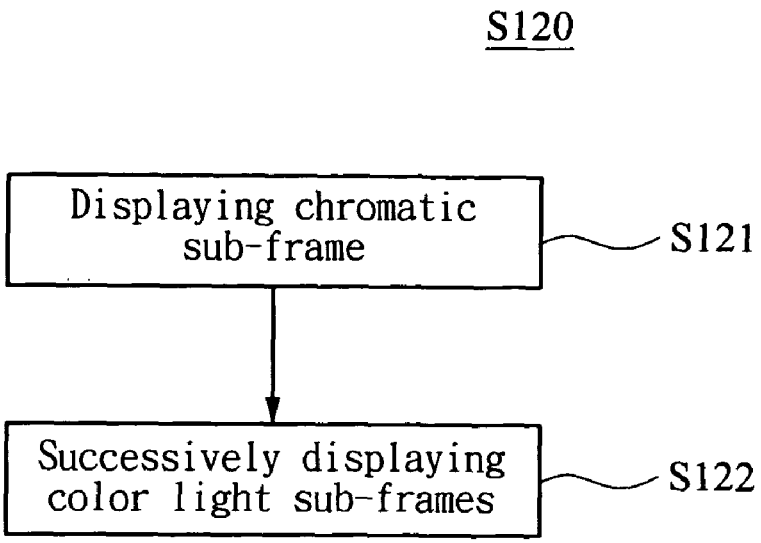
FIG. 4A is a flow chart of an embodiment of displaying each sub-frame according to the present invention.
Figure 4B:
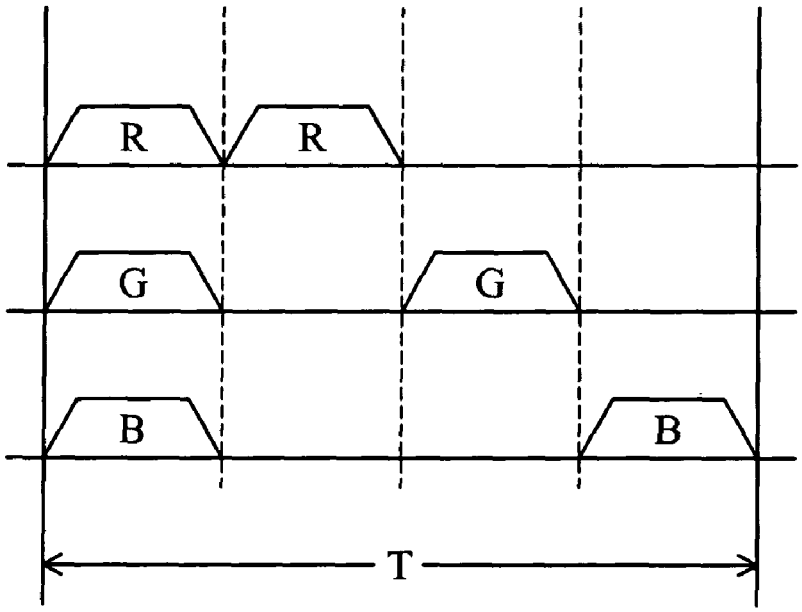
FIG. 4B illustrates an exemplificative time sequence of displaying each sub-frame according to the present invention.
Figure 5A:
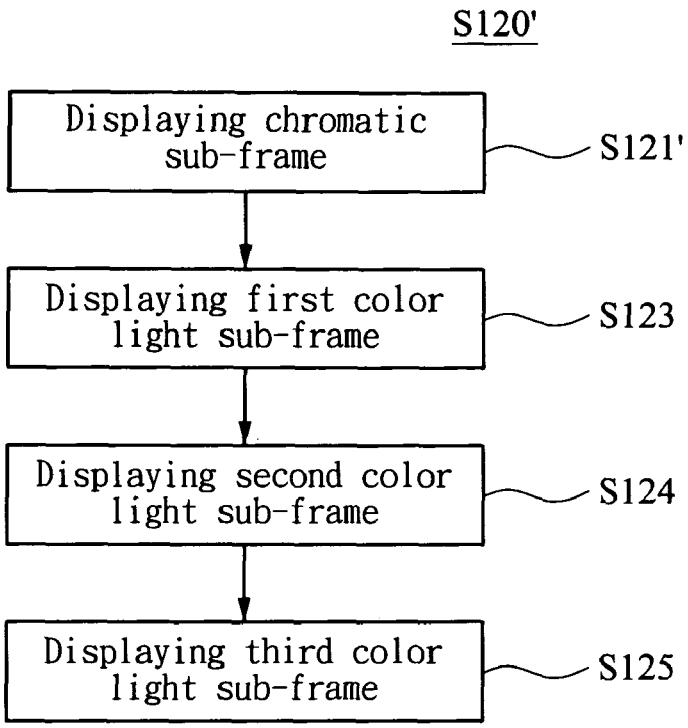
FIG. 5A is another flow chart of an embodiment of displaying each sub-frame according to the present invention.
Figure 5B:
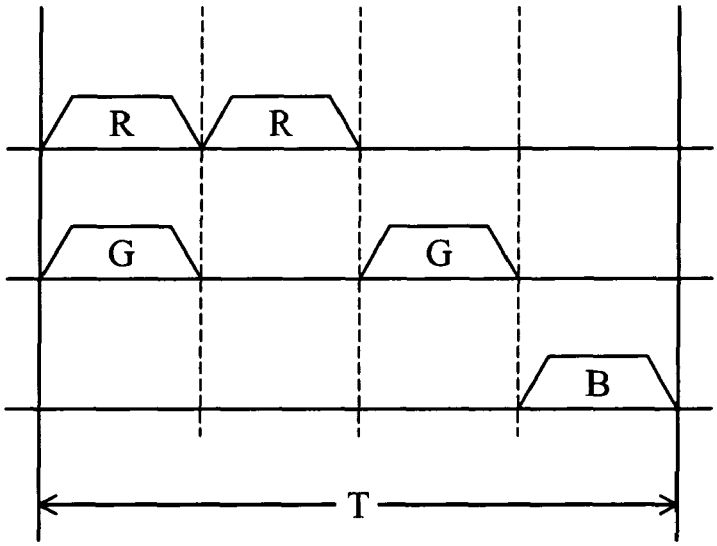
FIG. 5B illustrates another exemplificative time sequence of displaying each sub-frame according to the present invention.
Figure 6A:
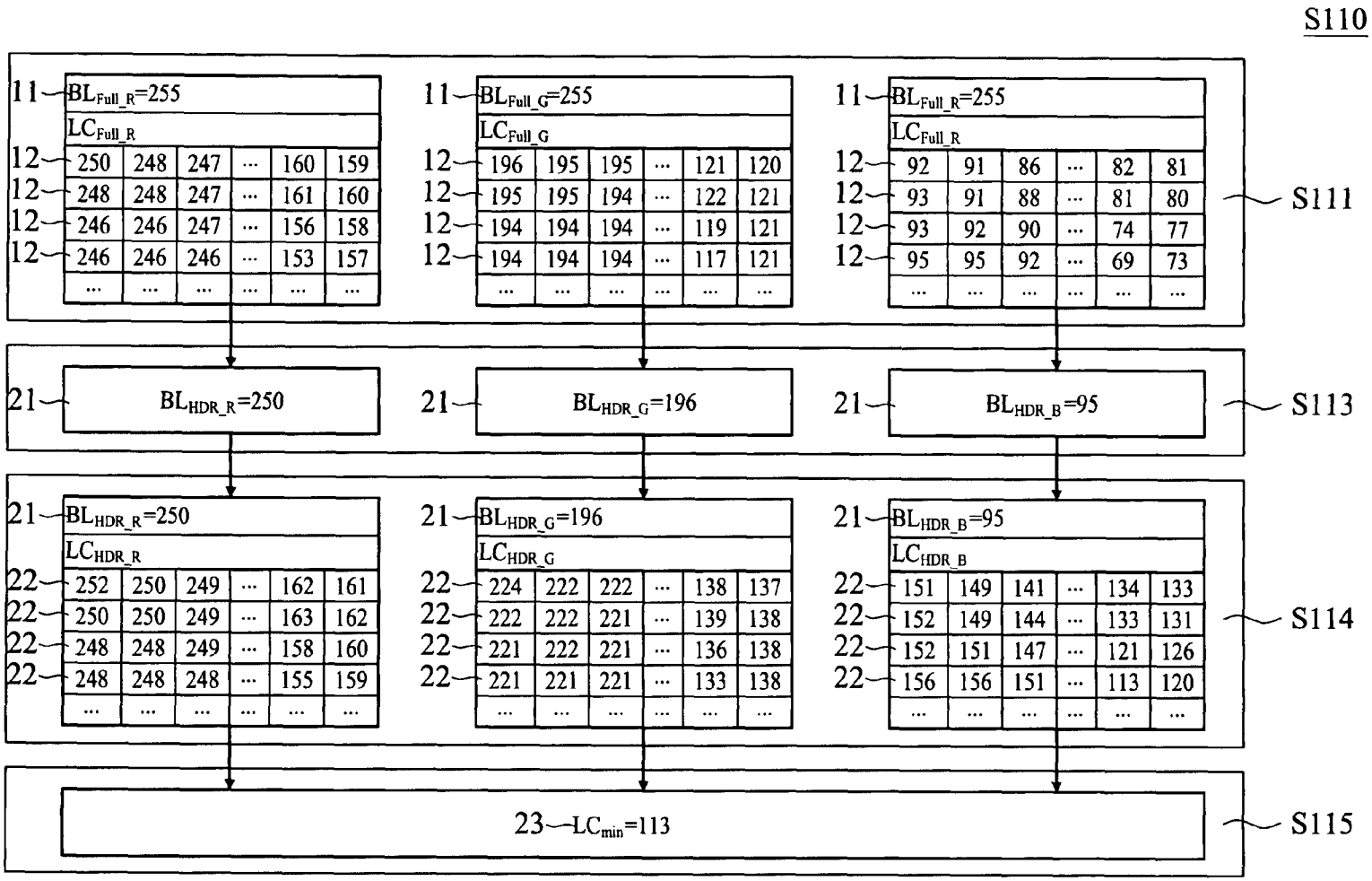
FIG. 6A is a flow chart of generating the control signal in some display region in FIG. 3.
Figure 6B:
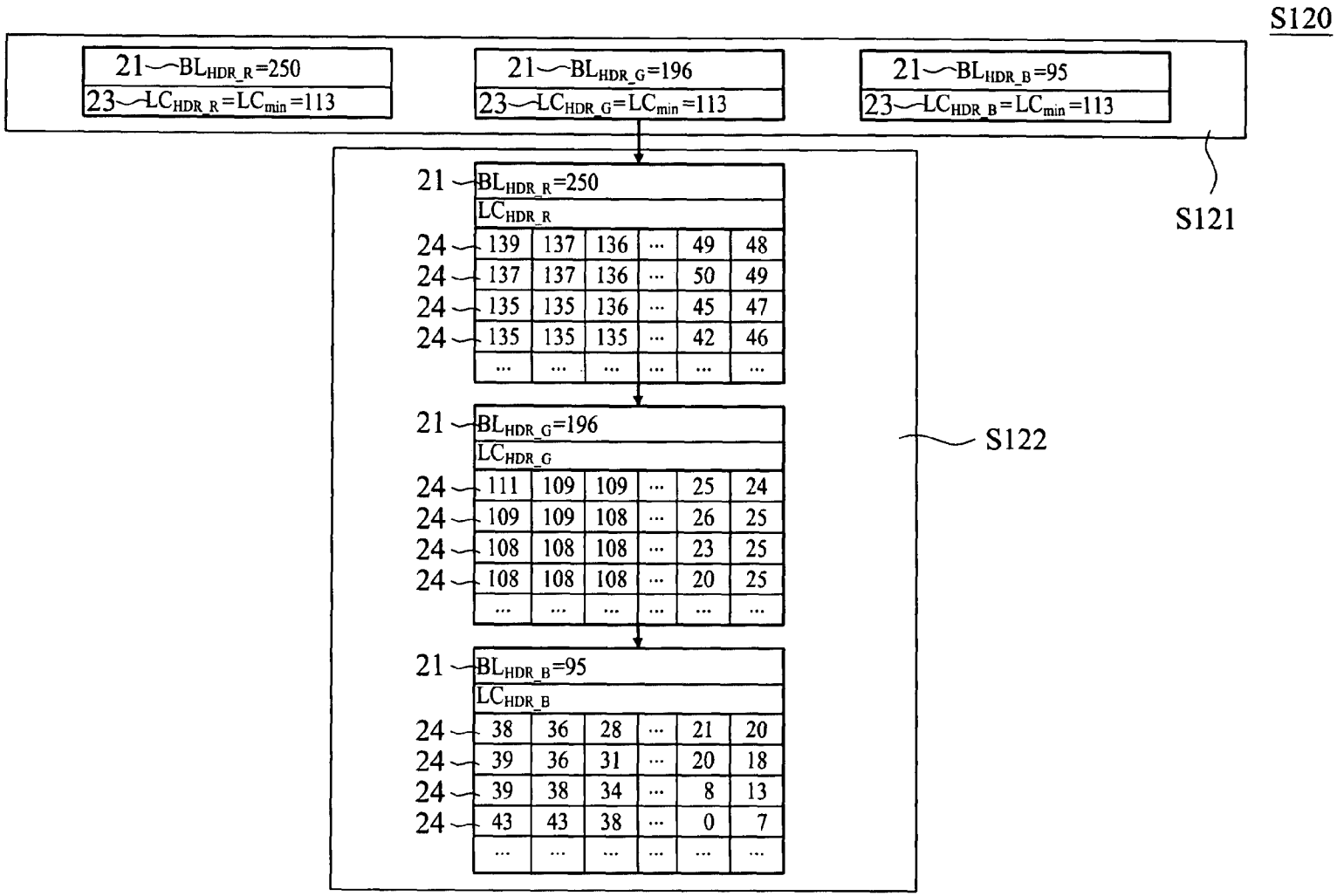
FIG. 6B is a flow chart of successively displaying sub-frame according to the control signal generated by FIG. 6A.

FIG. 1 is a flow chart of an embodiment of a display method for an LCD device with reduced color break-up S100 according to the present invention. FIG. 2 is a flow chart of an embodiment of generating control signals for each sub-frame S110 according to the present invention. FIG. 3 is an embodiment of a chromatic image to be displayed according to the present invention. FIG. 4A is a flow chart of an embodiment of displaying each sub-frame S120 according to the present invention. FIG. 4B illustrates an exemplificative time sequence of displaying each sub-frame S120 according to the present invention. FIG. 5A is another flow chart of an embodiment of displaying each sub-frame S120' according to the present invention. FIG. 5B illustrates another exemplificative time sequence of displaying each sub-frame S120' according to the present invention. FIG. 6A is a flow chart of generating the control signal in a certain display region in FIG. 3. FIG. 6B is a flow chart of successively displaying sub-frame according to the control signal generated by FIG. 6A.

As shown in FIG. 1, the present embodiment illustrates a display method for an LCD device with reduced color break-up S100, comprising the following steps: generating a control signal for each sub-frame S110, and displaying the sub-frames successively S120.

The control signal of each said sub-frame comprises a plurality of second backlight control signals, a plurality of second LC control signals, and a third LC control signal. The second backlight control signals function for controlling brightness of backlight of a backlight module while the second LC control signals function for controlling transmittance ratio of LCD. The stronger the second LC control signals are, the higher the transmittance ratio of LCD is and the brighter the screen is. In the present embodiment, gray value of backlight brightness and gray value of LCD are used to indicate magnitude of the second backlight control signals and the second LC control signals.

According to FIG. 2, the method for generating control signals for each sub-frame S110 comprises the following steps: analyzing an input image signal S111, dividing the sub-frame into a plurality of display regions S112, generating the second backlight control signals for each color light in each said display region S113, generating the second LC control signals for each color light at each pixel in each said display region S114, and generating the third LC control signal for each said display region S115. As to the step of analyzing input image signal S111, when there is an image as shown in FIG. 3 to be displayed, the input image signal comprises information such as a first backlight control signal and a first LC control signal. For instance, if the backlight brightness is in full intensity, it means the first backlight control signal is at the maximum of the gray value of the backlight brightness. For example, if an 8-bit control signal is implemented, the first backlight control signal is 255.

When the backlight brightness is in full intensity, the LCD device employs the first LC control signal to control the transmittance ratio of LCD for each pixel so as to display colors with various degrees of brightness. Thus, the first LC control signal and the first backlight control signal in each said pixel can be acquired respectively by analyzing the input image signal.

As to the step of dividing the sub-frame into a plurality of display regions S112, since there may be brighter portions and darker portions in a chromatic image, the sub-frame can be divided into the plurality of display regions so that the backlight brightness for each said display region can be respectively controlled according to the brightness of the display region. In FIG. 3, for instance, the sub-frame may be divided into 4×4 display regions.

As to the step of generating the second backlight control signal for each color light in each said display region S113, in each said display region, a value is derived from the first LC control signal of each color light and used as the second backlight control signal. Thereupon, a user can optionally, for instance, take a maximum value, an average value, or a value calculated by dividing the average value of the first LC control signal by a total order of the control signal to get a quotient, deriving a root of the quotient to normalize the quotient, and then multiplying the root by the total order, as the second backlight control signal.

For example, in the case that the maximum value of the first LC control signal in the display region is taken as the second backlight control signal, if the maximum value of the first LC control signal is 95, the second backlight control signal is also 95. Since the pixel having the maximum value of the first LC control signal is the brightest pixel in the display region, once the backlight brightness is directly aligned to the best brightness in the display region, the power consumption of the backlight module can be reduced.

That is, by modulating the backlight in each display region in the manner that in darker display regions, the backlight is weakened or even shut off while in brighter display regions, the backlight is augmented, and using the second LC control signals to change the transmittance ratio of LCD, the chromatic image to be displayed can be viewed and the objectives of reducing power consumption and enhancing screen contrast can be achieved.

As to the step of generating the second LC control signal for each color light at each pixel in each said display region S114, since the finally displayed chromatic image shall have light intensity equal to that of the chromatic image generated by the input image signal, the second LC control signal can be derived from the given second backlight control signal through the following equation:

$$GL_{HDR}=GL_{Full}\times(BL_{Full}/BL_{HDR})^{1/r} \quad (1)$$

Therein, $GL_{HDR}$ is the second LC control signal; $BL_{Full}$ is the first backlight control signal; $BL_{HDR}$ is the second backlight control signal; r is a gamma factor; and $GL_{Full}$ is the first LC control signal. Besides, in view of possible interference among the backlight sources of the display regions, $BL_{Full}$ in the above equation (1) may be replaced by the light intensity of the first backlight control signal while $BL_{HDR}$ may be replaced by the light intensity of the second backlight control signal, so as to derive the second LC control signal of enhanced accuracy and appropriateness.

In the step of generating the third LC control signal for each said display region S115, the third LC control signal is generated from all the second LC control signals for each said color light and may be smaller than or equal to the minimum value among all the second LC control signals for the color light.

According to FIG. 4A, for displaying the sub-frames successively S120, following steps are conducted: displaying a chromatic sub-frame S121, and successively displaying the color light sub-frames S122.

In the step of displaying the chromatic sub-frame S121, as shown in FIG. 4B, the chromatic sub-frame is formed by simultaneously displaying all the color light sub-frames according to the second backlight control signals of all the color lights in each said display region in company with the third LC control signal. The chromatic sub-frame may be a screen constructed from three color lights, namely, a red light, a green light and a blue light. Therein, the backlight brightness of each said color light is controlled by the second backlight control signal of each said color light, respectively, while the transmittance ratio of LCD is controlled by the third LC control signal.

In the step of successively displaying the color light sub-frames S122, each said color light sub-frame is displayed according to the second backlight control signal of the color light in each said display region in company with a calculation of the second LC control signal and the third LC control signal at each pixel. Therein, the calculation may be the difference between the second LC control signal and the third LC control signal. However, different ways of generating the calculation may be also implemented without limitation and a user may make alteration thereto for obtaining desired screen quality.

As shown in FIG. 4B, only when the chromatic sub-frame and all the color light sub-frames are displayed in a time cycle T, a chromatic image can be viewed as an integral through human vision. The chromatic sub-frames may, for example, as shown in FIG. 4B, be displayed in the way that red light, green light and blue light sub-frames are displayed simultaneously, wherein the second backlight control signal and second LC control signal of each said color light sub-frame are deployed as described above.

Furthermore, in the present embodiment, the chromatic sub-frame may be displayed by displaying only two of the three primary colors simultaneously, as shown in FIG. 5A. An alternative way to display the sub-frames successively S120' comprises the following steps: displaying the chromatic sub-frame S121', displaying a first color light sub-frame S123, displaying a second color light sub-frame S124, and displaying a third color light sub-frame S125.

In the step of displaying a chromatic sub-frame S121', as shown in FIG. 5B, a first color light and a second color light are selected from three different color lights and then the second backlight control signal of the first color light and the second backlight control signal of the second color light are used in company with the third LC control signal to display the chromatic sub-frame. Therein, the first color light and the second color light may be selected from the group consisting of a red light, a green light and a blue light. Meantime, the third LC control signal may be smaller than or equal to the minimum value between the second LC control signals of the first and the second color lights. For example, assuming that the first color light is the red light and the second color light is the green light, the chromatic sub-frame is actually a yellow light sub-frame that is displayed according to the second backlight control signal of the red light and the second backlight control signal of the green light in company with the third LC control signal.

In the step of displaying the first color light sub-frame S123, the first color light sub-frame is displayed according to the second backlight control signal of the first color light in company with a calculation of the second LC control signal and third LC control signal of the first color light at each pixel. Therein the calculation may be the difference between the second LC control signal and the third LC control signal. However, different ways of generating the calculation may be also implemented without limitation and a user may make alteration thereto for obtaining desired screen quality. Since the chromatic sub-frame has partially displayed the first color light, the calculation between the second LC control signal and the third LC control signal has to be done and then the second backlight control signal is used in company with the calculation of the LC control signals to display the first color light sub-frame.

In the step of displaying the second color light sub-frame S124, the second color light sub-frame is displayed according to the second backlight control signal of the second color light in company with a calculation between the second LC control signal and third LC control signal of the second color light at each pixel. Therein the calculation may be the difference between the second LC control signal and the third LC control signal. Similarly, Since the chromatic sub-frame has partially displayed the second color light, operation between the second LC control signal and the third LC control signal has to be done and then the second backlight control signal is used in company with the calculation of the LC control signals to display the second color light sub-frame.

In the step of displaying the third color light sub-frame S125, the third color light sub-frame is displayed according to the second backlight control signal of the third color light in company with the second LC control signal of the third color light at each pixel. Since the chromatic sub-frame has not displayed the third color light, calculation between the second LC control signal and the third LC control signal has not to be done and the second LC control signal can be directly displayed in company with the second backlight control signal of the third color light.

As in FIG. 5B, the chromatic sub-frame may be the yellow light sub-frame by displaying the red light and the green light.

Alternatively, the chromatic sub-frame may be a cyan light sub-frame (not shown) by displaying the green light and the blue light. Or, the chromatic sub-frame may be a magenta light sub-frame (not shown) by displaying the red light and the green light and then successively displaying the first, second and third color light sub-frames, wherein the display sequence of the color light sub-frames is not limited.

Since the chromatic sub-frame has partially displayed the color lights, by successively displaying each said color light sub-frame, the lack of colors in the chromatic sub-frame can be complemented. Moreover, due to the inserted chromatic sub-frame, the duration where each said color light sub-frame is displayed is shortened relatively so that the contribute of each said color light to the image can be reduced and in turn color break-up is suppressed.

For further illustrating the present embodiment, an exemplificative flow chart of the disclosed method is provided in FIG. 6A, wherein a process S120 of generating the second backlight control signal 21, the second LC control signal 22 and the third LC control signal 23 in a certain display region of FIG. 4 is described.

According to FIG. 6A, by analyzing the input image signal S111, the first backlight control signal 11 of each said color light and the first LC control signal 12 in each pixel can be derived. It is learned from FIG. 6A that the first backlight control signal 11 of the red light is 255, and the first LC control signal 12 is 250, 248, 246, 264, etc. The first backlight control signal 11 of the green light is 255, and the first LC control signal 12 is 196, 195, 194, 194, etc. The first backlight control signal 11 of the blue light is 255, and the first LC control signal 12 is 92, 93, 93, 95, etc.

Then the first LC control signal of each color light is used to generate the second backlight control signal, respectively S113. For instance, when the maximum value among the first LC control signals 12 is taken as the second backlight control signal 21 of each color light, in the certain display region, the second backlight control signal 21 of the red light is 250; the second backlight control signal 21 of the green light is 196; and the second backlight control signal 21 of the blue light is 95.

Afterward, the second LC control signal of each color light is to be produced S114. Since the finally displayed chromatic image shall have light intensity equal to that of the chromatic image generated by the input image signal, the second LC control signal 22 of each pixel can be derived from the equation (1). If the gamma factor in the equation (1) is 2, after calculation, the second LC control signal 22 of the red light is 252, 250, 248, 248, etc; the second LC control signal 22 of the green light is 244, 222, 221, 221, etc; and the second LC control signal 22 of the blue light is 151, 152, 152, 156, etc.

At last, the third LC control signal is to be produced S115. Assuming that the minimum value among the second LC control signals 22 of the red, green and blue lights is taken as the third LC control signal 23, the third LC control signal 23 is 113. However, the user can also select a value smaller than the minimum value among the second LC control signals 22 as the third LC control signal 23 according to the screen to be displayed.

FIG. 6B illustrates the process of successively displaying the sub-frames according to the control signals of each said color light S120. The second backlight control signals 21 of the red, green and blue colors are used in company with the third LC control signal 23 to display the chromatic sub-frame S121. Since the third LC control signal 23 is the minimum value among the second backlight control signals 21 of the red, green and blue colors, the chromatic sub-frame displays part of the colors of the chromatic image to be displayed.

Then, the color light sub-frames are displayed successively S122. Therein, the red light sub-frame, the green light sub-frame, and the blue light sub-frame are successively displayed while the display sequence of the color lights is not limited. According to the sequence shown in FIG. 6B, the first color light sub-frame is the red light sub-frame; the second color light sub-frame is the green light sub-frame; and the third color light sub-frame is the blue light sub-frame.

For instance, the second backlight control signal 21 of the red light sub-frame is 250 and is used in company with the calculation 24 of the second LC control signal 22 and the third LC control signal 23, e.g. 139, 137, 135, 135, etc. to display the red light sub-frame. Similarly, the second backlight control signal 21 of the green light sub-frame is 196 and the second backlight control signal 21 of the blue light sub-frame is 95, which are respectively used in company with the calculations 24 of the second LC control signal 22 and the third LC control signal 23 thereof to display the green and blue light sub-frames. In virtue of the aforementioned method, chromatic images can be displayed with reduced color break-up.

Although the particular embodiments of the invention have been described in detail for purposes of illustration, it will be understood by one of ordinary skill in the art that numerous variations will be possible to the disclosed embodiments without going outside the scope of the invention as disclosed in the claims.

What is claimed is:

1. A display method for an LCD device with reduced color break-up, comprising following steps:

generating a control signal for each of a plurality of sub-frames in a display, wherein the control signal comprises of a plurality of second backlight control signals, a plurality of second LC control signals and a third LC control signal, and the control signal is generated by following steps:

analyzing an input image signal to derive a first LC control signal and a first backlight control signal of each color light at each pixel;

dividing a display area of each said sub-frame into a plurality of adjacent display area regions;

generating the second backlight control signal of each said color light in each said display area region according to the first LC control signals;

generating the second LC control signal of each said color light in each said display area region at each said pixel according to the second backlight control signal; and generating the third LC control signal for each said display area region; and successively displaying the plurality of sub-frames, by the following steps:

displaying a multi-color sub-frame in response to the second backlight control signal of each said color light in each said display area region and the third LC control signal corresponding to each said display area region; and successively displaying color light sub-frames, wherein each said color light sub-frame is displayed according to the second backlight control signal of the color light in each said display area region in company with a calculation between the second LC control signal and the third LC control signal of the color light in each said pixel.

2. The display method of claim 1, wherein the color lights are a red light, a green light and a blue light.

3. The display method of claim 1, wherein the second backlight control signal of each said color light in each said display area region is a maximum value among the first LC control signals.

4. The display method of claim 1, wherein the second backlight control signal of each said color light in each said display area region is an average value of the first LC control signals.

5. The display method of claim 1, wherein the second backlight control signal of each said color light in each said display area region is a value calculated by dividing an average value of the first LC control signals by a total order of the backlight control signals to get a quotient, deriving a root of the quotient, and then multiplying the root by the total order.

6. The display method of claim 1, wherein the second LC control signal for each said color light at each said pixel in each said display area region is derived from following equation:

$$GL_{HDR}=(BL_{Full}/BL_{HDR})^{1/r}*GL_{Full}$$

wherein, $GL_{HDR}$ is the second LC control signal; $BL_{Full}$ is the first backlight control signal; $BL_{HDR}$ is the second backlight control signal; r is a gamma factor; and $GL_{Full}$ is the first LC control signal.

7. The display method of claim 1, wherein the third LC control signal is a minimum value among the second LC control signals.

8. The display method of claim 1, wherein the third LC control signal is smaller than or equal to a minimum value among the second LC control signals.

9. The display method of claim 1, wherein the calculation is a difference between the second LC control signal and the third LC control signal.

10. A display method for an LCD device with reduced color break-up, comprising following steps:

generating a control signal for each of a plurality of sub-frames in a display, wherein the control signal comprises of a plurality of second backlight control signals, a plurality of second LC control signals and a third LC control signal, and the control signal is generated by following steps:

analyzing an input image signal to derive a first LC control signal and a first backlight control signal of each color light at each pixel;

dividing a display area of each said sub-frame into a plurality of display area regions;

generating the second backlight control signal of each said color light in each said display area region according to the first LC control signals;

generating the second LC control signal of each said color light in each said display area region at each said pixel according to the second backlight control signal; and generating the third LC control signal of each said display area region; and successively displaying the sub-frames, by the following steps:

displaying a multi-color sub-frame by selecting a first color light and a second color light, and using the second backlight control signal of the first color light and the second backlight control signal of the second color light in company with the third LC control signal corresponding to each said display area region;

displaying a first color light sub-frame by using the second backlight control signal of the first color light and a calculation between the second LC control signal and the third LC control signal of the first color light at each said pixel;

displaying a second color light sub-frame by using the second backlight control signal of the second color light and the calculation between the second LC control signal and the third LC control signal of the second color light at each said pixel; and displaying a third color light sub-frame by using the second backlight control signal of the third color light and the second LC control signal of the third color light at each said pixel.

11. The display method of claim 10, wherein the color lights are a red light, a green light and a blue light.

12. The display method of claim 10, wherein the second backlight control signal of each said color light in each said display area region is a maximum value among the first LC control signals.

13. The display method of claim 10, wherein the second backlight control signal of each said color light in each said display area region is an average value of the first LC control signals.

14. The display method of claim 10, wherein the second backlight control signal of each said color light in each said display area region is a value calculated by dividing an average value of the first LC control signals by a total order of the backlight control signals to get a quotient, deriving a root of the quotient, and then multiplying the root by the total order.

15. The display method of claim 10, wherein the second LC control signal for each said color light at each said pixel in each said display area region is derived from following equation:

$$GL_{HDR}=(BL_{Full}/BL_{HDR})^{1/r}*GL_{Full}$$

wherein, $GL_{HDR}$ is the second LC control signal; $BL_{Full}$ is the first backlight control signal; $BL_{HDR}$ is the second backlight control signal; r is a gamma factor; and $GL_{Full}$ is the first LC control signal.

16. The display method of claim 10, wherein the third LC control signal is a minimum value among the second LC control signals of the first color light and the second color light.

17. The display method of claim 10, wherein the third LC control signal is smaller than or equal to a minimum value among the second LC control signals of the first color light and the second color light.

18. The display method of claim 10, wherein the calculation is a difference between the second LC control signal and the third LC control signal.

19. A display method for an LCD device with reduced color break-up, comprising following steps:

generating a control signal for each of a plurality of sub-frames in a display, wherein the control signal comprises of a plurality of second backlight control signals, a plurality of second LC control signals and a third LC control signal, and the control signal is generated by following steps:

analyzing an input image signal to derive a first LC control signal and a first backlight control signal of each color light at each pixel;

dividing a display area of each said sub-frame into a plurality of display area regions;

generating the second backlight control signal of each said color light in each said display area region according to the first LC control signals;

generating the second LC control signal of each said color light in each said display area region at each said pixel according to the second backlight control signal; and generating the third LC control signal of each said display area region; and successively displaying the sub-frames, by the following steps:

displaying a multi-color sub-frame according to the second backlight control signal of each said color light in each said display area region in company with the third LC control signal corresponding to each said display area region, wherein the multi-color sub-frame generated by at least two different color lights of a plurality of said color lights; and successively displaying color light sub-frames, wherein each said color light sub-frame is displayed according to the second backlight control signal of the color light in each said display area region in company with a calculation between the second LC control signal and the third LC control signal of the color light in each said pixel.

* * * * *